US007885385B1

(12) United States Patent
Boyce

(10) Patent No.: US 7,885,385 B1
(45) Date of Patent: Feb. 8, 2011

(54) TUNABLE X-RAY SOURCE

(75) Inventor: James R. Boyce, Williamsburg, VA (US)

(73) Assignee: Jefferson Science Associates, LLC, Newport News, VA (US)

( * ) Notice: Subject to any disclaimer, the term of this patent is extended or adjusted under 35 U.S.C. 154(b) by 364 days.

(21) Appl. No.: 12/156,527

(22) Filed: Jun. 2, 2008

(51) Int. Cl.
*H05G 2/00* (2006.01)

(52) U.S. Cl. ..... 378/119

(58) Field of Classification Search ..... 378/119
See application file for complete search history.

(56) References Cited

U.S. PATENT DOCUMENTS 3,886,366 A * 5/1975 Kash ..... 378/119

* cited by examiner

*Primary Examiner*—Courtney Thomas

(57) ABSTRACT

A method for the production of X-ray bunches tunable in both time and energy level by generating multiple photon, X-ray, beams through the use of Thomson scattering. The method of the present invention simultaneously produces two X-ray pulses that are tunable in energy and/or time.

4 Claims, 3 Drawing Sheets

TUNABLE X-RAY SOURCE

The United States of America may have certain rights to this invention under Management and Operating Contract DE-AC05-060R23177 from the United States Department of Energy.

FIELD OF THE INVENTION

The present invention relates to X-ray sources and more particularly an X-ray source that is tunable in time and/or energy.

BACKGROUND OF THE INVENTION

Current methods in the study of the structure of proteins, researchers are limited to in their ability to analyze the motion or dynamics of proteins due to the necessity of using frozen proteins since there currently exists no practical method for studying these entities dynamically or in motion, i.e. when energy is added to a frozen protein, what part thereof moves first and by what amount? For example a great deal of energy has been devoted to determining how a protein binds to DNA to cause a particular cell to grow into a liver cell instead of a brain cell.

Thus there exists a need for a method for studying and mapping the dynamics of protein activity that allows researchers to make such determinations.

OBJECT OF THE INVENTION

It is therefore and object of the present invention to provide a method for producing energy and time tunable X-ray sources that permit the study of the dynamics of protein activity.

SUMMARY OF THE INVENTION

The present invention provides a method for the production of X-ray bunches tunable in both time and energy level by generating multiple photon, X-ray, beams through the use of Thomson scattering. The method of the present invention simultaneously produces two X-ray pulses that are tunable in energy and/or time.

DETAILED DESCRIPTION

With the advent of high power electron accelerators and free electron lasers, it has become feasible to generate multiple photon beams off relativistic electron bunches by the well known process of Thomson or Compton scattering. The present invention uses this capability to simultaneously produce two energy photon (X-ray) pulses that are tuneable in energy and in time.

Figure 1:
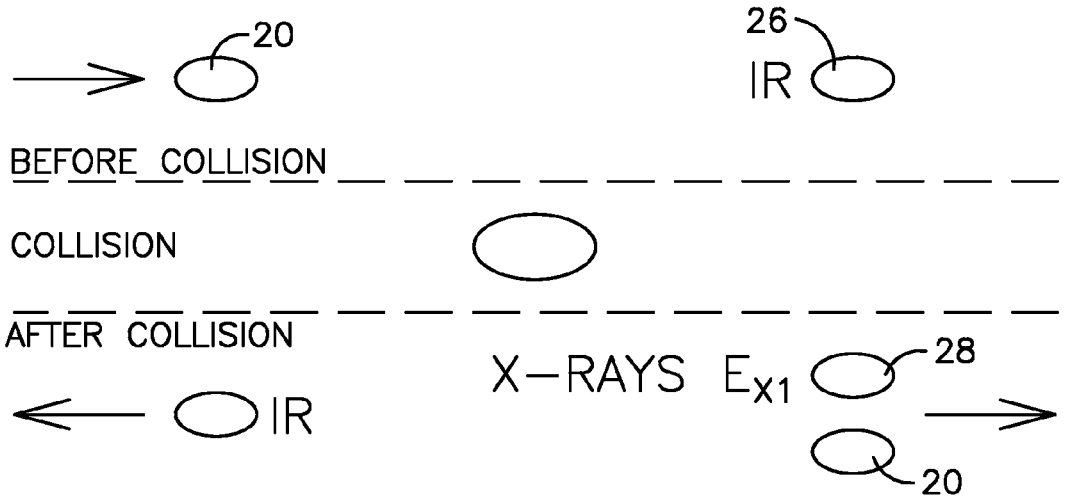
FIG. 1 (PRIOR ART)
FIG. 1 is a schematic representation of standard 180° Thompson Scattering with photonic energy as known in the prior art.

Referring now to the accompanying drawings, as shown in FIG. 1, in a standard 180° Thomson Scattering, when an electron bunch 20, produced by an appropriate electron source such as a free electron laser or particle accelerator (not shown), collides with infrared radiation 26 at an angle of 180°, X-rays 28 are produced that travel with electron bunch 20 after the infrared radiation scatters off electrons in the impact region. Such X-rays 28 exhibit an energy $E_{x1}$.

Figure 2:
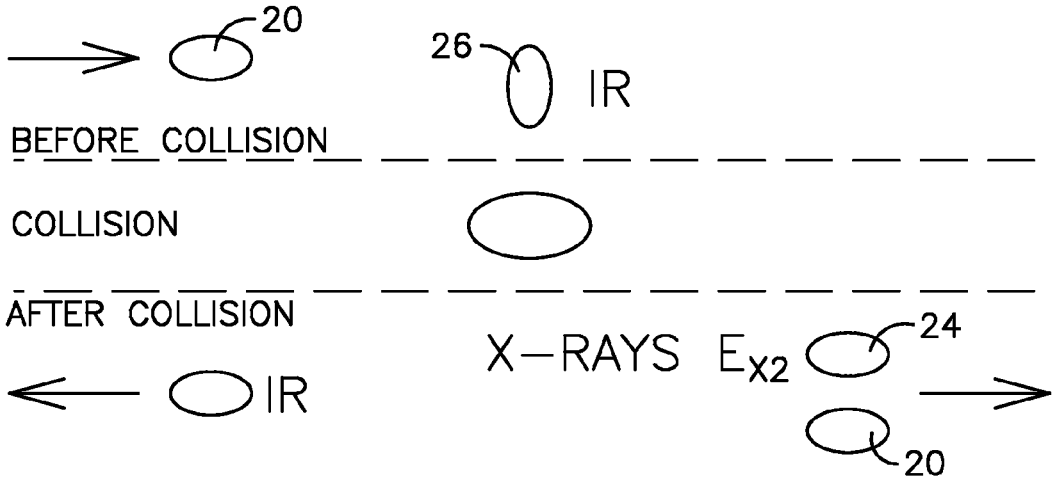
FIG. 2 (PRIOR ART)
FIG. 2 is a schematic representation of standard 90° Thompson Scattering with infrared energy as known in the prior art.

As shown in FIG. 2, in standard 90° Thomson Scattering when an electron bunch 20, produced by an appropriate electron source, collides with infrared radiation (IR) at an angle of 90°, X-rays 24 are produced that travel with electron bunch 20 after the infrared radiation scatters off electrons in the impact region. Such X-rays exhibit an energy $E_{x2}$.

Figure 3:
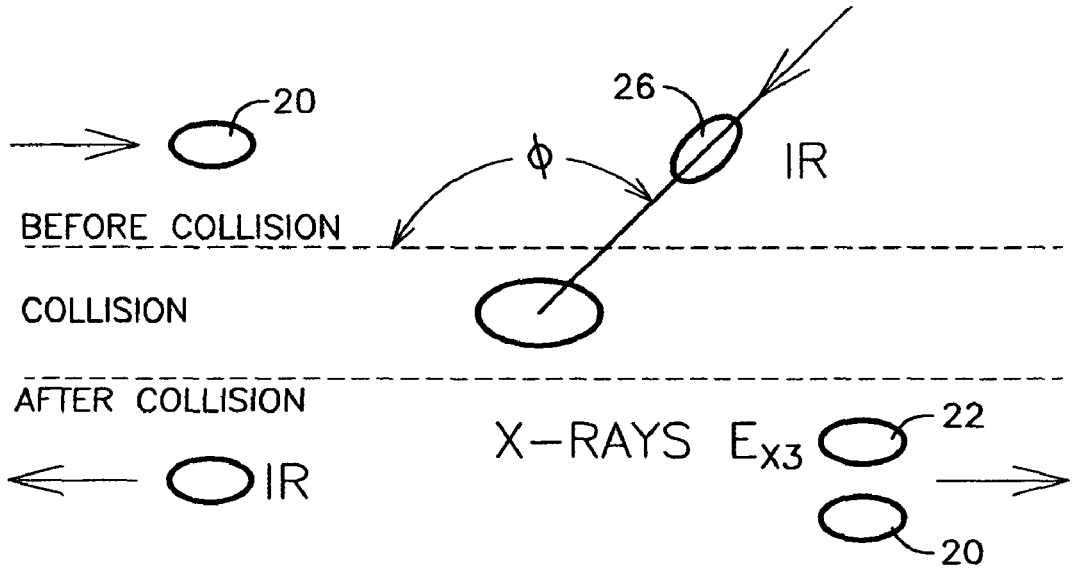
FIG. 3 is a schematic representation of Thompson Scattering with infrared energy through an angle θ.

As shown in FIG. 3, when Thomson Scattering occurs through impact of an electron bunch $e^-$ with infrared radiation at an angle Φ, X-rays 22 are produced that are traveling with the electron bunch 20 after the infrared radiation scatters off electrons, but with an energy represented by the formula $E_{x3}=E_{x1}[\cos(\phi)+1/\beta]$.

Thus, it is known that regardless of where the infrared radiation hits the electron bunch, the X-rays produced are traveling along with the electrons at the speed of light. If two bunches of x-rays are being produced, one with scattering from 180° and the other from scattering at an angle ϕ, both X-ray bunches are not separated in time and are thus simultaneous. In this case, the infrared radiation is striking the electron bunch at the same physical location in the beam line. The present invention takes advantage of the fact that if the infrared radiation at angle 4 strikes the electron bunch before or after the infrared radiation at 180° strikes it, that both bunches of x-rays are also simultaneous and not separated in time. Thus these two beams can be used to probe a sample at essentially the same time. By changing the angle ϕ, one can tune the difference in energies between the two x-ray bunches. Thus, X-rays of different energy levels can be generated simultaneously thus providing the ability to view different portions of proteins simultaneously Such an arrangement is depicted schematically in FIG. 4 wherein simultaneous Thomson Scattering with infrared radiation at an angle ϕ and "head-on" or at an angle of 180° occurs. In this case, X-rays are produced at two different energies $E_{x\Phi}$ and $E_{x2}$ and are traveling with electron bunch 20. The lower energy X-rays 32 are tunable since the angle ϕ can be independently varied using suitable infrared radiation optics. X-rays 30 and 32 are then directed to a target 34.

Figure 4:
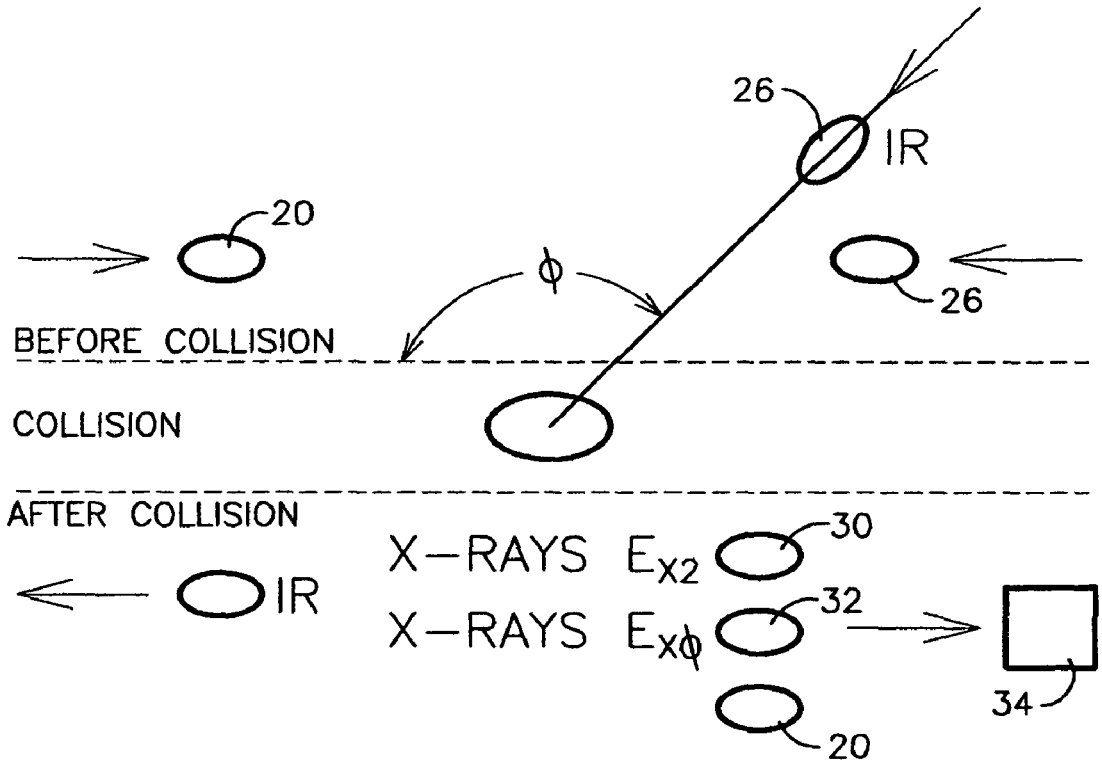
FIG. 4 is a schematic representation of simultaneous Thompson Scattering with infrared energy through an angle θ and head on at an angle of 180° in accordance with the present invention.

As is apparent from FIG. 4, in order to produce the effects described herein, the first application of infrared radiation must impact the electron bunch at an angle Φ of less than 180° while the second application of infrared energy must impact the electron bunch at an angle of 180° in order to produce the desired result of producing two simultaneous X-ray beams of differing energy.

Figure 5:
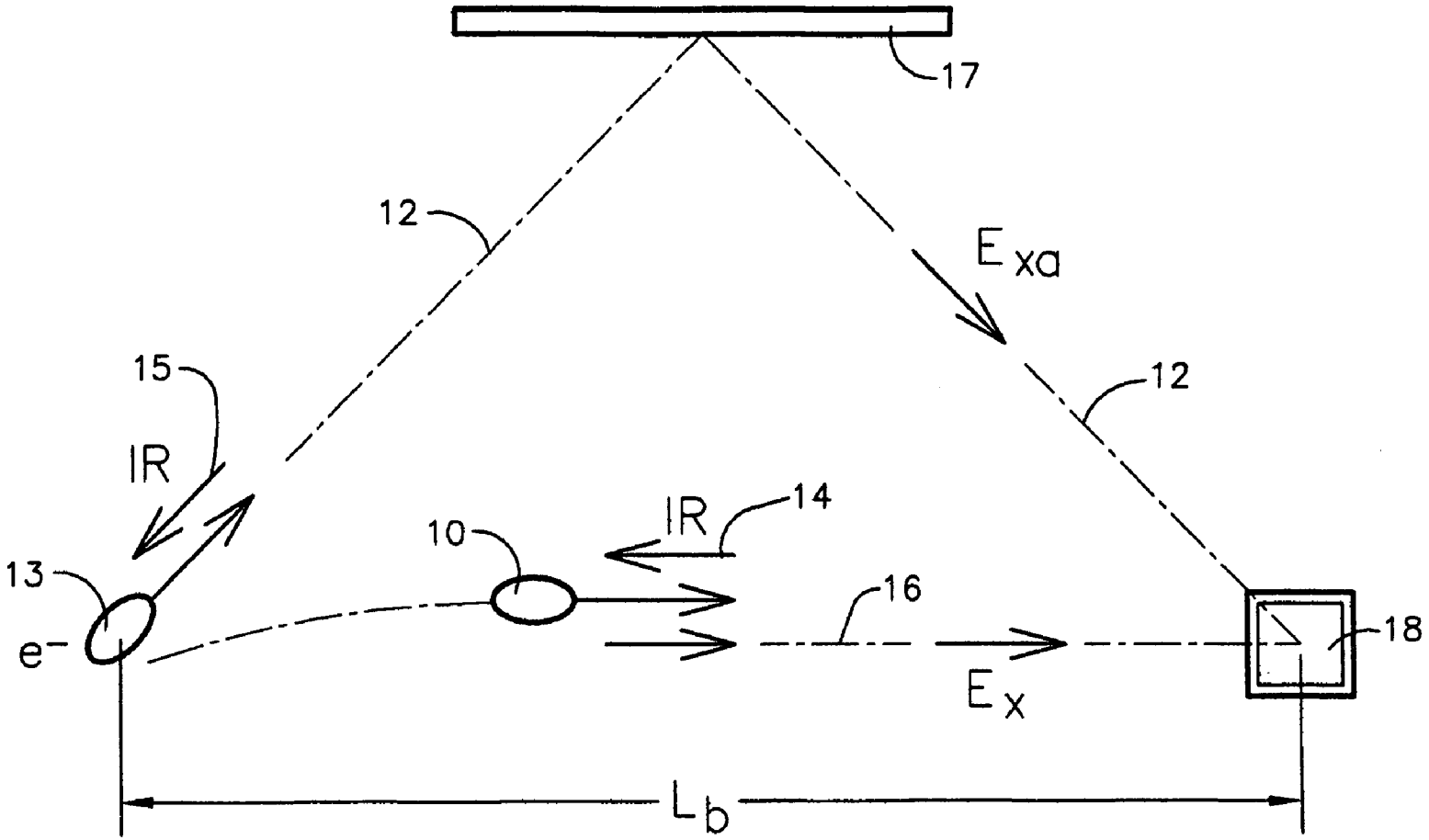
FIG. 5 is a schematic depiction of an alternative embodiment of the present invention wherein X-rays are tunable in time through the use of a mirror.

FIG. 5 depicts an alternative embodiment of the present invention wherein a single electron bunch 13 is impacted by a first burst of infrared radiation 15 that deflects electron bunch $e^-$ forming a deflected electron bunch 10 and generates a beam of X-rays 12 having energy $E_{xa}$ that travels toward an X-ray mirror 17 and is reflected therefrom to a target 18. Deflected electron bunch 10 is then impacted at an angle of 180° by a second burst of infrared radiation 14 producing a second X-ray beam 16 with an energy $E_x$ that is directed toward target 18. The time difference between the two x-ray bunches 12 and 16 can be varied by changing the path length difference the two x-rays bunches 12 and 16 travel en route to sample 18.

Thus, X-rays from first X-ray bunch 12 are generated at a steeper angle than the X-rays from second bunch 16. Once produced, X-ray bunch 12 will be traveling in the direction electron bunch 10 are moving at the time of infrared scattering, while second x-ray bunch 16 is also moving in the direction of the electrons at the time of their production. Because electron bunch 10's direction has been changed, second electron bunch 10 is traveling in a different direction from electron bunch 13. An x-ray mirror 17 is then used to reflect first X-ray bunch 12 back to sample 18. By varying the angle (and thus the path length) of first X-rays bunch 12, the time of arrival of the two x-ray bunches 12 and 16 can be tuned, thus separating bunches 12 and 16 in time. This then can be used for time-domain pump-probe investigations.

While the invention has been described in the context of the impacting radiation being infrared radiation, it will be readily understood that the radiation impacting the laser or particle beam may comprise any photonic radiation including but not limited to infrared, ultraviolet and visible radiation and all such types of radiation should be considered operative in the method of the present invention.

There has thus been described a method for tuning X-rays in both time and energy for purposes of dynamically analyzing protein activity.

As the invention has been described, it will be apparent to those skilled in the art that the same may be varied in many ways without departing from the spirit and scope of the invention. Any and all such modifications are intended to be included within the scope of the appended claims.

What is claimed is:

1. A method for the simultaneous production of X-rays of different energies comprising simultaneously impacting an electron beam with: A) photonic energy at an angle less than about 180 degrees; and B) infrared energy at an angle of 180 degrees to simultaneously produce two X-ray beams of differing energy to be delivered to a single target.

2. The method of claim 1 wherein the photonic energy is infrared energy.

3. A method for the production of X-rays tuneable in time comprising impacting an electron beam with a first beam of photonic energy at an angle less than about 180 degrees to produce a deflected electron beam and a first angularly displaced X-ray beam, impacting the deflected electron beam with a second beam of infrared energy at an angle of 180 degrees to produce a second X-ray beam, reflecting the first angularly displaced X-ray beam to a target with a mirror and delivering the second X-ray beam directly to the target such that the first and second X-ray beams arrive at the target at different times.

4. The method of claim 3 wherein the photonic energy is infrared energy.

* * * * *